United States Patent [19]

Jacobs

[11] 4,309,127

[45] Jan. 5, 1982

[54] APPARATUS FOR CONTROLLING SUBMARINE OIL LEAKAGE

[76] Inventor: Reginald E. Jacobs, 46 Colebrook St., Hartford, Conn. 06112

[21] Appl. No.: 151,963

[22] Filed: May 21, 1980

[51] Int. Cl.[3] ..... E02B 15/04

[52] U.S. Cl. ..... 405/60; 210/923; 220/85 A; 220/85 B; 405/210

[58] Field of Search ..... 405/60, 210, 195; 210/923, 170; 220/85 A, 85 B

[56] References Cited

U.S. PATENT DOCUMENTS

| | | | |
|---|---|---|---|
| 2,383,840 | 8/1945 | Benckert | 405/210 X |
| 3,518,836 | 7/1970 | Itokawa | 405/210 |
| 3,667,605 | 6/1972 | Zielinski | 405/60 UX |
| 3,762,548 | 10/1973 | McCabe | 210/923 X |
| 3,798,919 | 3/1974 | Hershner | 405/210 X |
| 3,800,951 | 4/1974 | Mourlon et al. | 210/923 X |
| 3,813,887 | 6/1974 | Kruger et al. | 405/188 |
| 4,047,390 | 9/1977 | Boyce | 405/210 X |
| 4,060,175 | 11/1977 | Rysaard | 220/85 B |

OTHER PUBLICATIONS

The Oil and Gas Journal, Jun. 19, 1972, p. 64.

*Primary Examiner*—Dennis L. Taylor
*Attorney, Agent, or Firm*—McCormick, Paulding & Huber

[57] ABSTRACT

An off-shore oil drilling and pumping platform supported on a downwardly opening leakage control tank assembly which cooperates with the sea bottom to define a substantial enclosure for containing a source of oil leakage near the sea bottom. Collapsible and distensible air bags are attached to the tank assembly above the top wall of the tank for movement between active and inactive positions. Conduits are provided for introducing fluid under pressure into and releasing fluid from the bags to respectively distend or collapse the bags. In inactive position, the bags are collapsed and disposed generally adjacent the top wall of the tank. In active position the bags are distended and extend generally laterally outwardly from the tank assembly to aid in underwater mobility in placing and installing the platform.

8 Claims, 4 Drawing Figures

APPARATUS FOR CONTROLLING SUBMARINE OIL LEAKAGE

BACKGROUND OF THE INVENTION

This invention relates in general to submergible apparatus for controlling submarine oil leakage from an oil source at or near the sea bottom and deals more particularly with apparatus of the type which includes a collector or tank which cooperates with the sea bottom to provide substantial enclosure of the leakage source.

Off-shore oil exploration and drilling operations present potentially serious sources of water pollution. A break in a well casing at or near the ocean floor or a crack or fissure in the subterranean rock structure adjacent an existing well, due to pressure build-up, will often cause a serious oil leakage which is most difficult to control. Heretofore apparatus has been provided which includes some form of tank or receptacle which cooperates with the sea bottom to provide a substantial enclosure around a source of leakage and which includes a means for pumping or otherwise removing oil or water contaminated with oil from the enclosure. Typical apparatus of the aforedescribed type is shown in U.S. Pat. No. 3,667,605 to Zielinski, issued June 6, 1972; U.S. Pat. No. 3,681,923 to Hyde, issued Aug. 8, 1972; and U.S. Pat. No. 3,879,951 to Mason, issued Apr. 29, 1975. The present invention is concerned with improvements in apparatus of the aforedescribed general type. More particularly, the present invention is directed to an improved apparatus adapted for underwater mobility to facilitate movement from a construction site at or near a shore to an off-shore location, as, for example, the site of an oil well or oil exploration and to facilitate installation or erection at the desired off-shore site.

SUMMARY OF THE INVENTION

In accordance with the present invention apparatus is provided for controlling leakage from a submarine oil source near the sea bottom and comprises non-buoyant downwardly opening collection receptacle means which has rigid substantialy impervious top and side walls for cooperating with the sea bottom to define a substantial enclosure containing the source of oil leakage. Buoyancy means aid in selectively maintaining the receptacle means in spaced relation to the sea bottom during transportation to the site of a submarine oil well or exploration and enable underwater maneuverability of the receptacle means and during installation at the site. The buoyancy means includes at least one distensible envelope which is attached to the receptacle means above its top wall for movement between active and inactive positions. In its inactive position the envelope is in a collapsed condition and disposed generally adjacent the top wall of the receptacle. The envelope in its active position is distended and extends laterally outwardly in spaced relation to the top wall. A means is provided for introducing fluid under pressure into and releasing it from the envelope to alter the condition of the envelope. Further means are provided for recovering collected oil from the enclosure.

DETAILED DESCRIPTION OF PREFERRED EMBODIMENT

Figure 1:
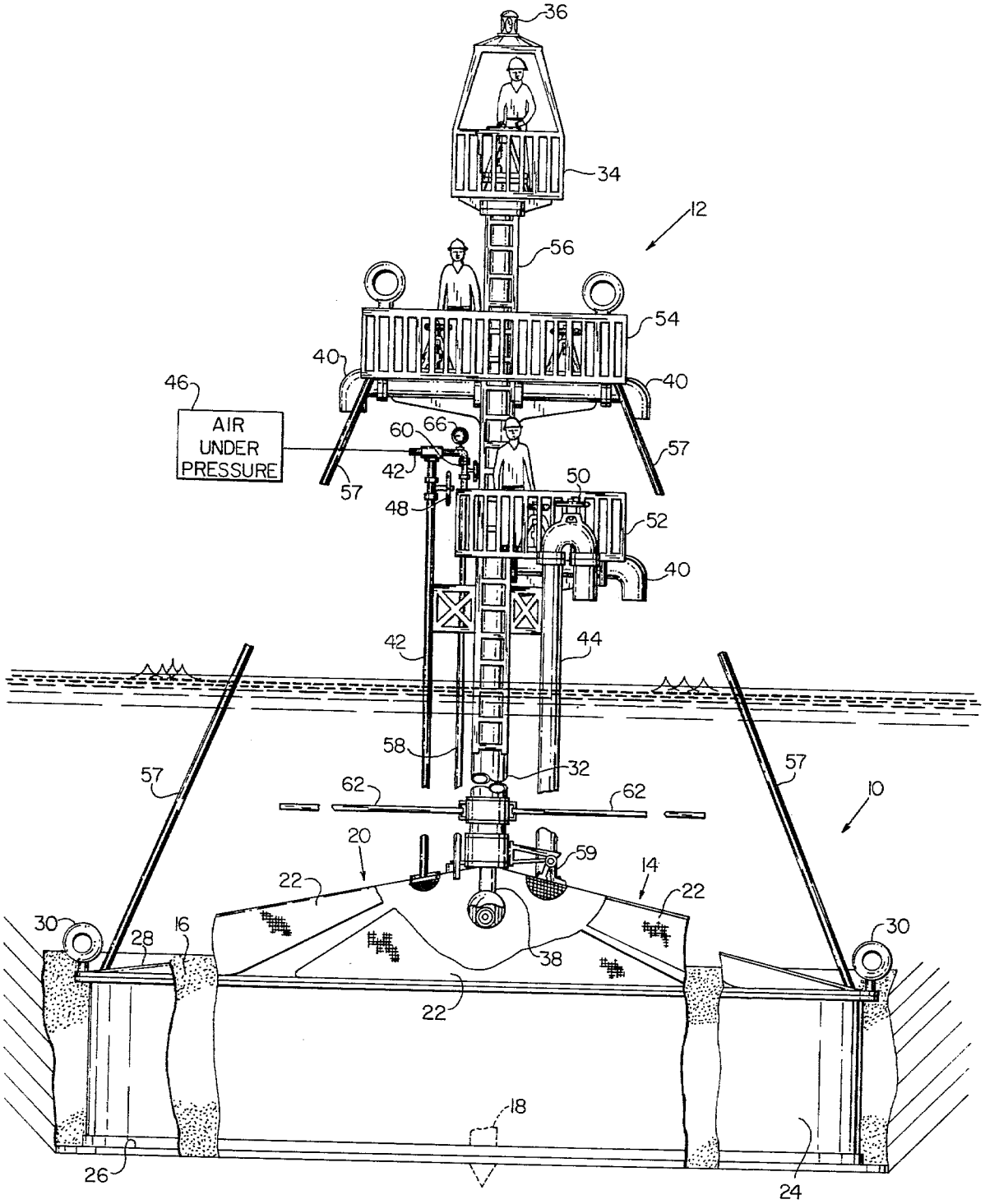
FIG. 1 is a side elevational view of an off-shore oil drilling and pumping station including submarine oil leakage control apparatus embodying the present invention.

Turning now to the drawings, and referring first particularly to FIG. 1, apparatus for controlling leakage from a submarine oil source, and indicated generally by the reference numeral 10, is shown embodied in an off-shore oil drilling and pumping station, designated generally by the numeral 12. The illustrated oil leakage control apparatus 10 comprises a nonbuoyant downwardly opening collection receptacle or tank assembly indicated generally at 14 which cooperates with the sea bottom to define a substantial enclosure 16 for containing a source or potential source of oil leakage at or near the sea bottom, as, for example, a plugged well conduit designated by the numeral 18. The apparatus 10 further has a buoyancy device indicated generally at 20 which includes at least one distensible envelope 22 attached to the tank assembly 14 for movement between active and inactive positions relative to the tank assembly, as will be hereinafter further described. The buoyancy device carries at least some of the weight of the tank assembly when it is moved to an underwater well or oil exploration site and aid in underwater mobility during installation of the collection tank assembly at the site.

The tank assembly 14 is preferably made from rigid corrosion resistant material, such as stainless steel or steel coated with a suitable corrosion resistant compound, such as rubber or the like. It is preferably made in sections which are bolted or otherwise connected together in assembly with suitable gaskets between the sections, as may be required, to provide a substantially watertight structure. The tank assembly is structurally reinforced to withstand the substantial hydraulic pressures to which it may be subjected when evacuated at substantial ocean depth and is preferably symmetrical about a vertical axis, substantially as shown. More specifically, the tank assembly 14 has a generally cylindrical side wall 24 surrounded at its lower end by a generally radially outwardly directed annular flange 26 which provides a footing for the tank on the ocean bottom. The tank assembly 14 is preferably domed and, as shown, has a generally conical top wall 28 which forms a flanged joint with the side wall 24. A plurality of circumaxially spaced lifting rings 30, 30 are provided at the upper peripheral edge of the tank assembly 14, substantially as shown. In FIG. 1 the tank assembly 14 is shown buried in a shallow excavation below the ocean floor. This installation arrangement prevents movement of the tank assembly relative to the oil source, which may, for example, be a well head, as a result of oceanic disturbances or the like.

A cylindrical steel casing 32 is bolted or otherwise secured at the central portion of the top wall 28 and extends upwardly therefrom to a position above the surface of the ocean. The casing 32 comprises the main structural support for a superstructure which includes conventional work platforms which comprise the drilling and pumping station 12. A drilling platform 34 supported near the upper end of the casing 32 carries a signal lamp 36 for night indication of the rig location. The casing 32 is adapted to coaxially receive the shank of a drill, such as indicated at 38 (FIG. 1) or, alternatively, the shaft of the tool (not shown) which may be used to cap the well. An annular flange at the upper end of the casing 32 is provided to receive a cap (not shown) which may be bolted in place with a gasket to seal the tank assembly 14 when the well is not producing or when it is exhausted.

Oil is drawn from a well or other submarine source through the casing 32 and through outlet pipes 40, 40 connected to the casing and communicating with its interior. The pipes 40, 40 are adapted for connection to flexible hoses which convey oil from the pumping station 12 to oil tankers, barges or the like, in a manner well known in the art.

Additional conduits or pipes 42 and 44 communicate with and extend upwardly from the tank assembly 14 for removing water trapped within the enclosure 16. The pipe 42 communicates with the enclosure 16 and is connected to a source of air under pressure, indicated somewhat schematically at 46. A gate valve 48 in the line 42 controls the flow of compressed air into the tank assembly 14. The line 44 also communicates with the interior of the tank assembly 14 and comprises a water discharge line. A gate valve 50 connected to the line 44 controls the flow of water from the enclosure 16. A network of platforms or catwalks 52 and 54 connected by ladders 56 provide access to the various gate valves which control operation of the drilling and pumping station 12. Additional structural support members 57, 57 connected between the periphery of the tank assembly 14 and the platform 54 impart further rigidity to the structure.

Figure 3:
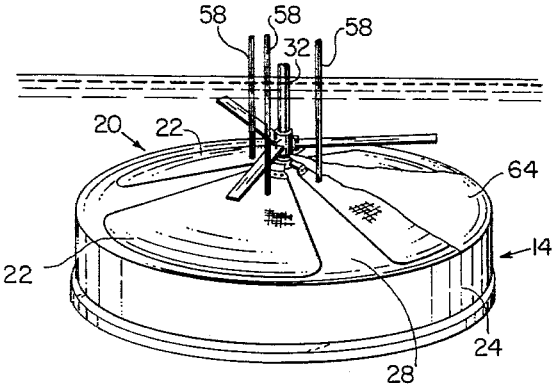
FIG. 3 is a somewhat reduced fragmentary perspective view of the structure of FIGS. 1 and 2 shown with the air bags in collapsed condition and in inactive position.
Figure 4:
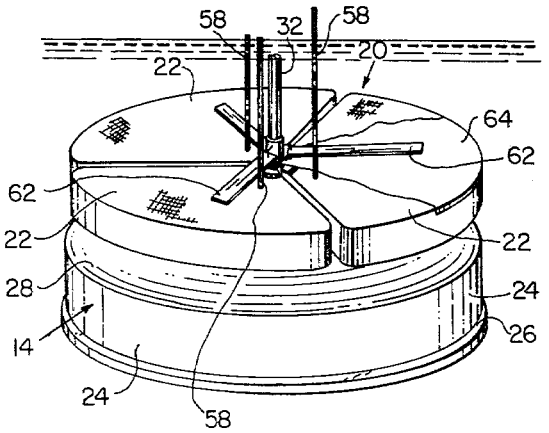
FIG. 4 is similar to FIG. 3 but shows the air bags in distended condition and in active position.

As previously noted, the buoyancy device 20 includes at least one buoyant distensible envelope 22 which is attached to the tank assembly 14 above its top wall 28 to impart underwater maneuverability to the tank assembly and its associated superstructure when the tank assembly is moved in a submerged condition to the site of a well head, oil exploration or the like. Preferably, and as shown the buoyancy device 20 comprises a plurality of substantially identical equiangularly spaced air bags 22, 22 connected by hinges 59, 59 to the casing 32 immediately above the top wall 28 for movement between active and inactive positions. In the inactive position, shown in FIG. 3, each air bag 22 is collapsed and disposed generally adjacent an associated portion of the top wall 28. The air bags are preferably made from nylon fabric or the like impregnated with rubber or a like compound which is substantially impervious to attack by sea water. Flexible air lines 58, 58 connected to the air bags 22, 22 and to the air supply line 42 through a valve 60 are provided for inflating the air bags to distended condition. In the latter condition the air bags 22, 22 assume active positions, shown in FIG. 4, wherein each air bag extends generally laterally outwardly relative to the tank assembly 14. A plurality of equiangularly spaced ouriggers 62, 62 connected to the casing 32 immediately above the air bags 22, 22 limit upwardly movement of the air bags from an inactive to active position and maintain the air bags in active position when the bags are inflated or distended.

Figure 2:
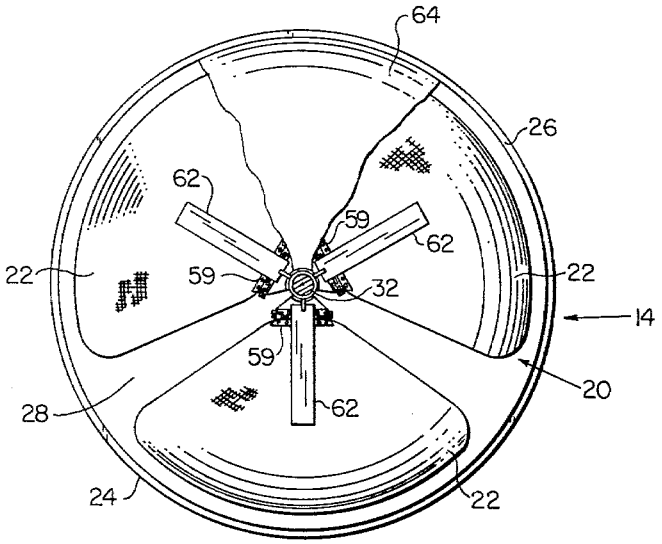
FIG. 2 is a sectional view taken along the line 2—2 of FIG. 1.

Preferably, and as best shown in FIG. 2 the apparatus 10 also includes a protective cover 64 which overlies the upper surfaces of the air bags 22, 22. The protective cover 64 is preferably made from a suitable flexible metalized fabric and assumes a position overlying the air bags when the bags are in collapsed inactive position overlying the upper surface 28 of the tank assembly.

The apparatus may be assembled at or near the shore and is transported to an oil well or oil exploration site with the tank assembly 14 in submerged condition. Submerging of the tank may be controlled by lines connected between the lifting rings 30, 30 and barges on the ocean surface. The tank is submerged with the air bags 22, 22 in collapsed, inactive condition. When the apparatus is submerged to desired depth in spaced relation to the ocean floor the air bags are inflated or distended by the introduction of compressed air through the valved lines 42 and 58, 58. An air pressure gauge 66 is provided for monitoring air pressure in the bags 22, 22. When activated by inflation the air bags 22, 22 assume wing-like positions and impart buoyancy to the heavy tank structure 14 to aid in underwater maneuverability while the structure is transported to and positioned at a desired underwater site by associated barges (not shown). Preferably, a suitable shallow excavation is dredged to receive the tank assembly. When the tank assembly is properly positioned the excavation is backfilled around it to maintain it in a substantially fixed position on the ocean floor. Various strainers associated with the conduits prevent clogging of the valves or lines with seaweed or other foreign matter during transportation and installation. When the tank assembly is properly positioned it cooperates with the sea bottom to define a substantial enclosure 16 around a potential source of oil leakage such as the well head 18. Water is then removed from the enclosure 16 by introducing compressed air through the line 42, the water being expelled through the pipe 44. Thereafter, the various valves associated with the leakage control apparatus are closed and drilling, pumping or capping operations may be performed in conventional manner.

I claim:

1. Apparatus for controlling leakage from a submarine oil source near the sea bottom, said apparatus comprising non-buoyant submergible downwardly opening collection receptacle means having rigid substantially impervious top and side walls for cooperating with the sea bottom to define a substantial enclosure containing the oil source, buoyancy means for supporting at least a portion of the weight of said receptacle means to aid in underwater maneuverability during positioning of said receptacle means at a submarine site and including at least one distensible envelope having collapsed and distended conditions, said envelope being attached to said receptacle means above said top wall and movable between active and inactive position being in collapsed condition and disposed generally adjacent said top wall, said envelope in its active position being in its distended condition and extending laterally outwardly in spaced relation to said top wall, means for introducing fluid under pressure into and releasing fluid under pressure from said envelope to alter the condition of said envelope, and means for recovering collected oil from said enclosure.

2. Apparatus for controlling leakage from a submarine oil source as set forth in claim 1 wherein said receptacle means comprises a tank assembly symmetrical about the vertical axis and said buoyancy means comprises a plurality of air bags equiangularly spaced about said axis.

3. Apparatus for controlling leakage from a submarine oil source as set forth in claim 2 wherein said air bags are hingedly connected to said tank assembly for movement between said active and inactive positions.

4. Apparatus for controlling leakage from a submarine oil source as set forth in claim 3 including means for limiting the upwardly movement of said air bags from said inactive to said active position and for maintaining said air bags in said active position when said air bags are in said distended condition.

5. Apparatus for controlling leakage from a submarine oil source as set forth in any one of claims 1 through 4 wherein said means for recovering collected oil comprises a conduit connected to said collector to communicate with said enclosure and extending to a position above the surface of the sea.

6. Apparatus for controlling leakage from a submarine oil source as set forth in claim 5 including conduit means connected to said receptacle and communicating with the said enclosure for introducing fluid under pressure into said enclosure to evacuate liquid from said enclosure.

7. Apparatus for controlling leakage from a submarine oil source as set forth in any one of claims 1 through 3 wherein said apparatus includes means defining a protective cover for overlying the upper surface of said envelope in said inactive position.

8. Apparatus for controlling leakage from a submarine oil source as set forth in any one of claims 1 through 3 wherein said apparatus includes a superstructure carried by said receptacle means and supported above the surface of the sea when said receptacle means is positioned at a submarine site and stabilizing means connected between said superstructure and the perimeter portion of said top wall.

* * * * *